US006702664B1

(12) United States Patent
Coven

(10) Patent No.: US 6,702,664 B1
(45) Date of Patent: Mar. 9, 2004

(54) PORTABLE FUME EXHAUSTER-CARPET AND FLOOR DRYER

(76) Inventor: Steven R. Coven, 1328 Linden Ave., Highland Park, IL (US) 60035

( * ) Notice: Subject to any disclaimer, the term of this patent is extended or adjusted under 35 U.S.C. 154(b) by 0 days.

(21) Appl. No.: 10/268,550

(22) Filed: Oct. 10, 2002

Related U.S. Application Data

(60) Provisional application No. 60/329,891, filed on Oct. 16, 2001.

(51) Int. Cl.[7] ..... E06B 7/02

(52) U.S. Cl. ..... 454/200; 416/146 R

(58) Field of Search ..... 454/200, 244; 416/146 R; 417/360, 423.15

(56) References Cited

U.S. PATENT DOCUMENTS 3,811,250 A * 5/1974 Fowler, Jr. ..... 96/422
4,181,471 A * 1/1980 Veronesi et al. ..... 417/360
4,466,780 A * 8/1984 Naurath ..... 417/360
4,497,999 A * 2/1985 Postbeschild ..... 392/381
4,716,409 A * 12/1987 Hart et al. ..... 340/825.22
4,773,310 A * 9/1988 Corwin ..... 454/244
5,030,068 A * 7/1991 Jacobs et al. ..... 417/363
5,295,811 A * 3/1994 Chiu ..... 417/423.15
5,334,000 A * 8/1994 Nordlin ..... 417/360
5,334,091 A * 8/1994 Shih-Chin ..... 454/210
5,702,296 A * 12/1997 Grano ..... 454/200
5,809,936 A * 9/1998 Wall ..... 119/484
6,003,195 A * 12/1999 Whitney ..... 15/314
6,126,415 A * 10/2000 Lasko ..... 417/423.15
6,336,793 B1 * 1/2002 Litvin ..... 417/360

* cited by examiner

*Primary Examiner*—Derek Boles
(74) *Attorney, Agent, or Firm*—Welsh & Katz, Ltd.

(57) ABSTRACT

A portable fume exhauster and dryer includes a motor fan mounted in a housing having a supporting structure adapted to rest on a horizontal surface, such as a floor, or on an uneven or slanted, often narrow surface, for example, a window sill. The housing of the exhauster and dryer has flanges at intake and exhaust openings to which grilles and/or conduits can be attached for remote intake or exhaust of fumes and moisture. Circuitry for the device may be provided to prevent electrical shock, power surges and thermal overload, and a switch may be proved for operation by an operator wearing protective clothing, such as heavy gloves.

15 Claims, 2 Drawing Sheets

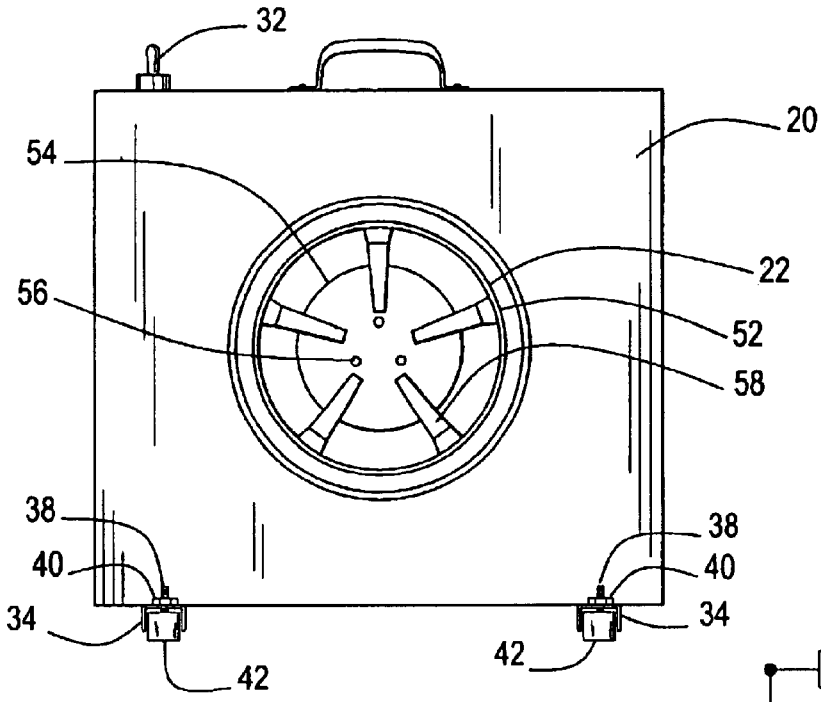
FIG. 3
FIG. 5
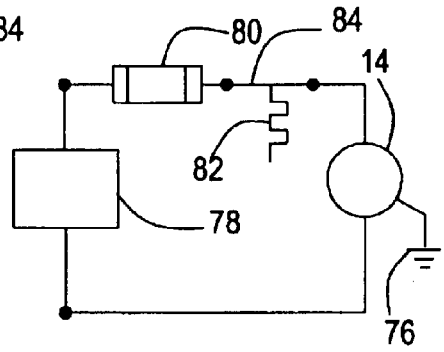
FIG. 4
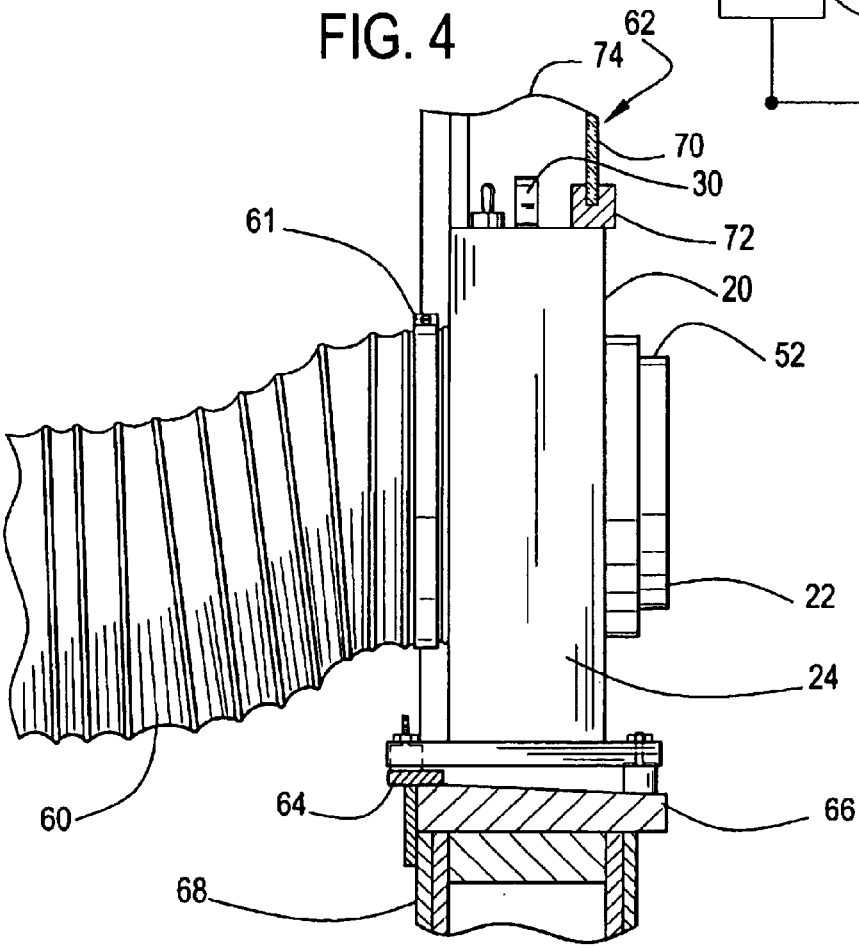

PORTABLE FUME EXHAUSTER-CARPET AND FLOOR DRYER

This application claims the benefit of U.S. Provisional Application No. 60/329,891, filed Oct. 16, 2001.

FIELD OF THE INVENTION

This invention relates to a portable fume exhauster and dryer, and more particularly to an improved exhauster and dryer adapted to be placed on a floor, in a window or a remote location for the exhausting of fumes or the drying of floors and carpeting or the removal of dust, such as saw dust, dry wall dust and contruction and remodeling dust.

BACKGROUND OF THE INVENTION

Fumes are often created within a room or other space upon the use of cleaning compositions, compositions, such as mastics and pastes for installing tile or other wall or floor coverings; and compositions for restoring or resurfacing fixtures, such as bathtubs, showers, lavatories, and the like. These fumes often are noxious, and their rapid removal is desirable, particularly where the fumes are present in a small space, such as a bathroom.

Additionally, floors and carpeting may become damp or wet intentionally in cleaning or unintentionally by flooding or spills, and requiring drying. One preferred method of drying is to circulate air over or in the vicinity of the damp or wet areas, for example, by use of a fan.

An example of an exhaust fan for exhausting fumes is disclosed in U.S. Pat. No. 3,069,933 issued to Bora which is intended to remove fumes from welding operations. The double fan device disclosed in that patent is adapted to be installed on a work bench or pedestal and connects to a damper unit which may be placed in a window. Another example of a portable ventilation system is shown in U.S. Pat. No. 5,702,296 issued to Grano, which uses a conduit having two separate passageways for a counter-flow effect.

The known fume exhausters and dryers are deficient in that they are complex often having several separate components, and hence are expensive, and require considerable set-up time.

Thus, there is a need for an uncomplicated, compact, portable exhauster and dryer which can be easily installed in a short time, does not present an electrical or thermal safety hazard, can be placed on a floor or carpeted surface or can be placed on an opening in a wall, such as a window, and can be readily operated by a user wearing bulky clothing, particularly thick gloves.

SUMMARY OF THE INVENTION

A portable fume exhauster and dryer in accordance with the present invention includes a motor fan mounted in a housing having a supporting structure which is adapted to rest on a horizontal surface, such as a floor, or on an uneven or slanted, often narrow surface, for example, a window sill. The device of the present invention includes a covering on the intake opening of the housing to prevent accidental contact with the fan apparatus and grounded circuitry to prevent electrical shock and thermal overload protection to prevent fires due to overheating. In addition, the device includes a readily accessible power switch which can be operated by a user with a heavily gloved hand. The portable fume exhauster and dryer of the present invention is also useful for removing dust, for example, saw dust, dry wall dust and construction and remodeling dust from an area or room.

These and other objects, advantages and features of the invention will be readily seen from the following description and drawing.

BRIEF DESCRIPTION OF THE DRAWINGS

FIG. 3 is a rear view of the exhauster-dryer shown in FIG. 1;

FIG. 4 is a side elevational view of the device of FIG. 1, temporarily installed in a window of a room with an intake conduit attached, the wall and window being shown in section;

FIG. 5 is a schematic illustration of the circuitry of the device of FIG. 1.

DESCRIPTION OF A PREFERRED EMBODIMENT

Figure 1:
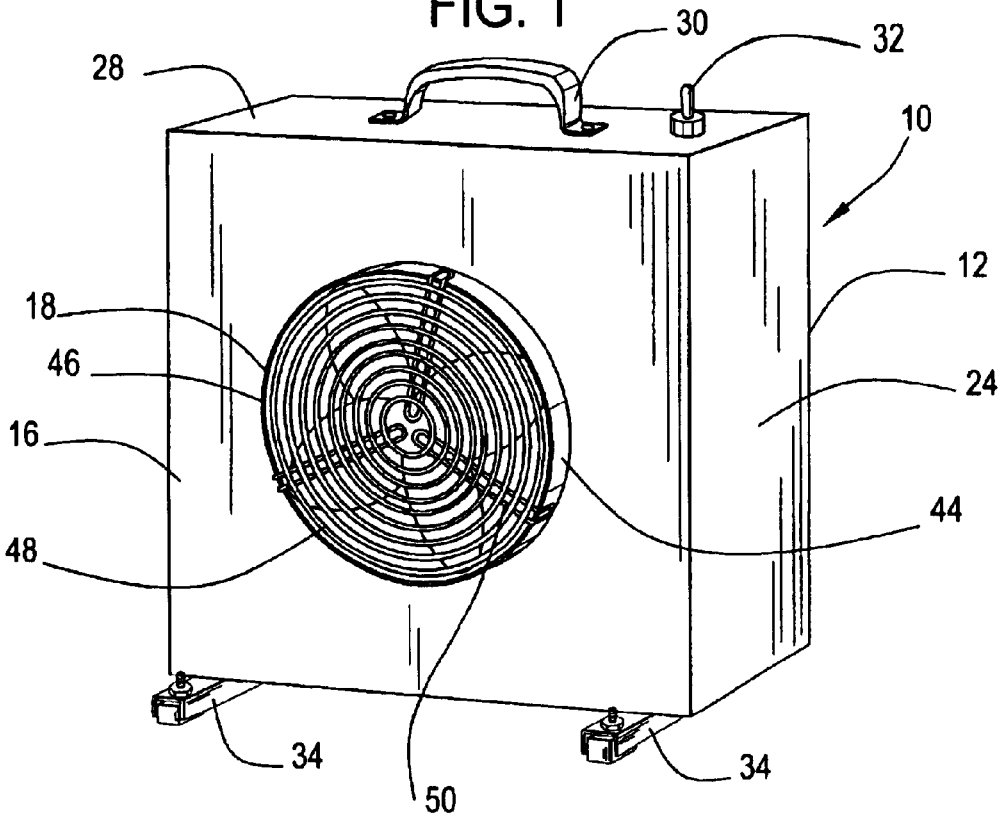
FIG. 1 is a front perspective view of the fume exhauster-dryer in accordance with the present invention.
Figure 2:
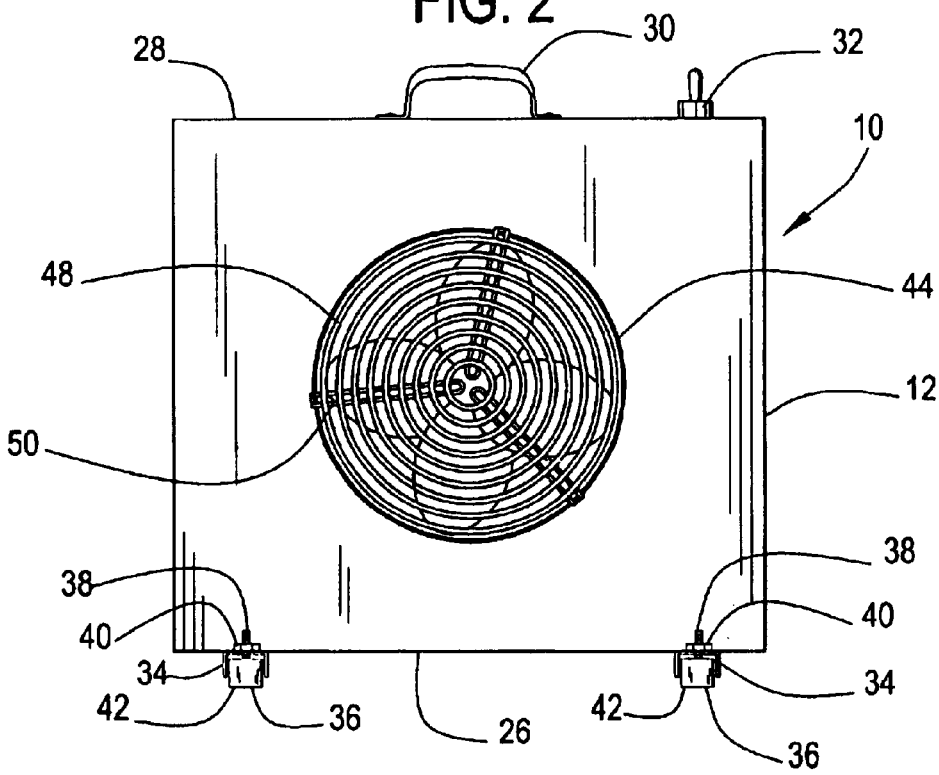
FIG. 2 is a front view of the exhauster-dryer shown in FIG. 1.

The exhauster-drawer shown in FIG. 1 comprises a portable device 10 including a housing 12 in which an in-line electric motor and fan unit 14 is mounted. Housing 12 has a front surface portion or panel 16 defining an intake opening 18; a rear portion or panel 20 defining an exhaust opening 22; side portions or panels 24, 24; a bottom portion or panel 26; and a top portion or panel 28 on which is positioned a handle 30 either integrally formed therein or if a panel, mounted thereon, and an on-off, push button switch 32. Panels 16, 20, 24, 26 and 28 may be of separate pieces, for example, of sheet metal fastened together, for example by suitable fasteners, such as screws and bolts (not shown) or a pair or more of the panels can be formed of bent metal with the remaining panels similarly fastened to the first mentioned panels. Housing 12 can also be molded of a durable plastic material. The formation of housings are known in the art.

A feature of the present invention is the provision of at least one pair of supporting members positioned at the bottom of housing 12, either integrally therewith or secured thereto, such as legs 34 screwed to bottom panel 26, preferably spaced apart at the side edge margins of the panel. As shown, the preferred legs are channel shaped providing maximum stability for the device. Also as shown, adjustable members 30 such as feet 36 are mounted to each of the at least one pair of the supporting members, e.g., legs 34, shown in the embodiment as adjacent the ends of the legs 34, which permit the device 10 to rest on the feet 36 on a floor, or on a table or other surface. Feet 36 in this embodiment are adjustable, for example by means of threaded rods 38 passing through nuts 40 and legs 34 with padded disks 42 contacting the floor or other surface. The disks 42 can be individually raised or lowered with respect to device 10 and legs 34 by advancing or retracting rods 38 through nuts 40 to compensate for slanted or uneven surfaces on which device 10 may otherwise rest. The adjustable members can be used to eliminate the marking of floors by the legs, and the potential for making lines on carpeted floors due to the bottom edges of the channels otherwise resting on the carpeting.

Housing 12, as heretofore noted, defines an intake opening 18 and an exhaust opening 22. In-line motor and fan 14 is positioned and mounted within housing 12 aligned with openings 18 and 22 so that the blades of the fan portion of 14 face opening 18 and create an air suction pulling ambient air and any fumes in the area into and through intake opening 18. Front surface portion or panel 16 defining opening 18 has a circular flange 44 extending outwardly from panel 16. Flange 44 is adapted to receive and support a grille 46 which may comprise concentric circular ring members 48 and struts 50, for example of aluminum wire, which struts support ring members 48 in position, for example by spot welding rings 48 to struts 50. Struts 50 also fasten grille 46 to flange 44, by having the ends of struts 50 bent at 90 degrees and secured to flange 44, for example, by spot welding. Grille 46 permits air and fumes to pass therethrough and into opening 18.

Rear panel 20 defining opening 22 also has a circular flange 52 extending outwardly. Flange 52 need not be fitted with a grille, but a grille may be provided on flange 52, if desired, in the same manner as flange 44 supports grille 46.

As best seen in FIG. 3 through opening 22 and flange 52, motor and fan unit 14 includes a rotable disk 54 bolted thereto with bolts 56 for rotation therewith, and housing 12 includes vanes 58 which are radial or inclined from the radial of the motor and fan unit shaft centerline. Disk 54 and vanes 58 enhance the flow of air and fumes through device 10.

The portable fume exhauster-carpet and floor dryer of the present invention can be readily utilized to exhaust fumes from a room in one aspect by placing the device 10 on the floor with legs 34 and feet 36 adjusted to support device 10 evenly on the surface. Desirably a flexible conduit, such as a plastic and metal hose (not shown), similar to an exhaust hose for a domestic gas clothes dryer, and similar to hose 60 shown in FIG. 4, can be attached to exhaust flange 52 by means of a metal band and hose clamp fastener (not shown, but commonly used with domestic gas clothes dryers), and led to the exterior of the room or dwelling, e.g., through a door or window. In this manner, operation of the device 10 will rapidly and efficiently remove fumes from a room. Such usage is particularly advantageous in removing fumes from a small room, such as fumes from a bathroom, for example, where tile has been installed with a mastic emitting solvent fumes or where a fixture, such as a bathtub or shower, has been restored or resurfaced, and fumes are emitted. However, the device 10 can be effectively utilized without hose or hoses 60.

In another aspect of the preferred embodiment, the device 10 may be temporarily mounted in a window, such as 62, as illustrated in FIG. 4. A window typically includes a sill 64 secured to a supporting member 66 as part of the wall 68, and a glass pane 70 in a sash 72 supported within a jamb 74. The device 10 is positioned on the sill 64 and the sash 72 is closed onto top panel 28 of housing 12 adjacent handle 30. A flexible conduit or hose 60 is secured to flange 44 of opening 18 by means of a ring clamp 61, with the other end (not shown) of hose 60 positioned near the source of the fumes to be removed. Upon operation of device 10, fumes are efficiently and rapidly exhausted from the room.

In still another aspect of the preferred embodiment, device 10 can be advantageously utilized to dry areas which are intentionally or unintentionally wet or damp, as by washing a floor or carpeting or by a flood or accidentally spilling of a liquid or by a leaking or burst water pipe. In this aspect, a flexible conduit, such as hose 60, can be secured to flange 52 of opening 22 and the device 10 can be placed on the floor or carpeting or installed in a window, as shown in FIG. 4, but with the intake opening 18 and grille 46 facing outwardly of window 62. The other end of the conduit, e.g. hose 60, can be directed to the wet or damp area of floor or carpet, and upon operation, a stream of air thus can be directed to the selected area to dry that area.

The fume exhauster-dryer of the present invention desirably is provided with an in-line electric motor and fan unit having sufficient capacity for optimum removal of fumes and drying of wet or damp areas. In this regard, it has been found that a unit 14 providing a flow of air of 548 cubic feet per minute is desirable, which flow is unrestricted by grille 46, but with grille 46 preventing small objects and fingers from entering the intake opening 18 and contacting the motor-fan unit. In addition, the device 10 of the present invention is protected against electric surges, thermal overload and electrical shock hazards by suitable circuitry as illustrated by the circuit in FIG. 5. As shown therein, the motor-fan unit 14 is grounded by ground 76 and the power from power source 78 is conducted through a fuse 80 and a thermal overload device 82 which may be a bimetallic contact element as shown operating a contact switch 84, or an overload heater element (not shown) or a solid state overload relay as shown in U.S. Pat. No. 5,222,009, incorporated herein by reference. In addition, the use of a push button on-off switch 32, allows the operator to operate device 10 while wearing protective clothing, e.g. heavy gloves. By use of the illustrated circuitry, the device and the operator are protected against electrical shock, power surges and thermal overloads.

In another aspect, not illustrated, a variable speed control can be incorporated into the circuitry, with a dial position on the top or side panel of housing 12, to permit the speed and hence the air flow, of the device at a level desired for the particular application for which the device is to be employed.

In still another aspect, device 10 of the present invention may be utilized to import air into a contaminated room or exhausted from a contaminated room or area over a considerable distance, for example 50 feet or more, through use of flexible hoses, such as hose 60. In addition, multiple devices 10 can be connected through such hoses to import air or exhaust fumes over longer distances, such as in buildings where windows are not openable.

While a particular embodiment of the portable fume exhauster-carpet and floor dryer of the invention has been shown and described, it will be appreciated by those skilled in the art that changes and modifications may be made thereto without departing from the invention in its broader aspects.

I claim:

1. A portable fume exhauster and dryer adapted to be supported on a surface comprising:

a. a housing having a bottom;

b. said housing including a front surface portion which defines an intake aperture;

c. said front surface portion has a flange extending outwardly with respect to said housing from adjacent said intake aperture;

d. said housing including a rear surface portion which defines an exhaust aperture;

e. said rear surface portion has a second flange extending outwardly with respect to said housing from adjacent said exhaust aperture;

f. a motor driven fan mounted in said housing for moving air therethrough from said intake aperture to sold exhaust aperture;

g. at least one pair of supporting members positioned at said bottom of the housing; and h. at least one adjustable member mounted to each of said supporting members adapted to adjustably support the fume exhauster and dryer on the surface.

2. The portable fume exhauster and dryer of claim 1, wherein said second flange is adapted to support one end of a flexible conduit capable of passing air therethrough.

3. The portable fume exhauster and dryer of claim 1, wherein said second flange is adapted to support a grille mounted thereto.

4. The portable fume exhauster and dryer of claim 3, wherein a grille covering said exhaust aperture is mounted to said flange.

5. The portable fume exhauster and dryer of claim 1, wherein said second flange is adapted to support one end of a flexible conduit capable of passing air therethrough and is adapted to support a grille mounted thereto.

6. The portable fume exhauster and dryer of claim 1, wherein said housing includes a top surface portion and a handle thereon.

7. The portable fume exhauster and dryer of claim 6, wherein said handle is integral with said top surface portion.

8. The portable fume exhauster and dryer of claim 6, wherein said handle is mounted on said top surface portion.

9. The portable fume exhauster and dryer of claim 1, wherein said motor driven fan mounted in said housing for moving air therethrough is electrically controlled by a switch mounted on said housing.

10. The portable fume exhauster and dryer of claim 9, wherein said switch is a push button switch capable of being operated by an operator wearing protective clothing.

11. The portable fume exhauster and dryer of claim 8, wherein said motor drive fan mounted in said housing for moving air therethrough is electrically controlled by electrical circuitry which includes elements for protection against electric surges, thermal overload and electric shock.

12. The portable fume exhauster and dryer of claim 11, wherein said circuitry includes a variable speed control the speed of the motor driven fan.

13. A portable fume exhauster and dryer adapted to be supported on a surface, comprising:

a. a housing having a bottom, a front surface portion, a rear surface portion, and a top portion;

b. said front surface portion defining an intake aperture and having a flange extending outwardly with respect to said housing from adjacent said intake aperture adapted to support a grille mounted thereto and adapted to support one end of a flexible conduit capable of passing air therethrough;

c. said rear portion defining an exhaust aperture and having a flange extending outwardly with respect to said housing from adjacent said exhaust aperture and adapted to support one end of a flexible conduit capable of passing air therethrough;

d. said top portion having a handle thereon;

e. a motor driven fan mounted in said housing for moving air from said intake aperture to said exhaust aperture;

f. at least one pair of supporting members positioned at said bottom of the housing; and g. at least one adjustable member mounted to each of said supporting members adapted to adjustably support the fume exhauster and dryer on the surface.

14. The portable fume exhauster and dryer of claim 13, wherein said motor drive fan mounted in said housing for moving air therethrough is electrically controlled by a push button switch mounted on said housing and being capable of being operated by an operator wearing protective clothing.

15. The portable fume exhauster and dryer of claim 13, wherein said motor driven fan mounted in said housing for moving air therethrough is electrically controlled by electrical circuitry which includes elements for protection against electric surges, thermal overload and electric shock.

* * * * *